US007181999B1

(12) United States Patent
Skeels et al.

(10) Patent No.: US 7,181,999 B1
(45) Date of Patent: Feb. 27, 2007

(54) TOOL FOR DRIVING COAXIAL CABLE CONNECTORS

(75) Inventors: Stephen J. Skeels, Cherry Valley, IL (US); Robert W. Sutter, De Kalb, IL (US)

(73) Assignee: Ideal Industries, Inc., Sycamore, IL (US)

( * ) Notice: Subject to any disclaimer, the term of this patent is extended or adjusted under 35 U.S.C. 154(b) by 0 days.

(21) Appl. No.: 11/302,615

(22) Filed: Dec. 14, 2005

(51) Int. Cl.
*B25B 13/06* (2006.01)
*B25B 13/48* (2006.01)

(52) U.S. Cl. ..... 81/124.2

(58) Field of Classification Search ..... 81/124.2, 81/DIG. 8, 121.1
See application file for complete search history.

(56) References Cited

U.S. PATENT DOCUMENTS 1,434,401 A * 11/1922 Mueller ..... 81/124.2
4,393,583 A * 7/1983 Zwald ..... 29/857
4,749,251 A * 6/1988 Moulin ..... 385/78
6,817,272 B2 * 11/2004 Holland ..... 81/124.2
2002/0002882 A1 * 1/2002 Jonett ..... 81/124.2
2004/0035259 A1 * 2/2004 Erwin ..... 81/124.2
2004/0035260 A1 * 2/2004 Adkison ..... 81/124.2

* cited by examiner

*Primary Examiner*—David B. Thomas
(74) *Attorney, Agent, or Firm*—Cook, Alex, McFarron, Manzo, Cummings & Mehler, Ltd.

(57) ABSTRACT

A driver tool for coaxial cable connectors is provided. The tool can drive both F-series coaxial cable connectors having a hex sleeve and BNC coaxial cable connectors having a bayonet sleeve. The driver tool has a socket which includes a first drive surface in the form of a plurality of flat segments formed on the socket and engageable in rotationally interlocking relation with the hex sleeve of an F connector. The socket also has a second drive surface in the form of a collar sized for frictional engagement in rotationally interlocking relation with the bayonet sleeve of a BNC connector. A longitudinal slot in the sleeve accommodates a coaxial cable. A handle and shaft connect to the socket.

20 Claims, 4 Drawing Sheets

TOOL FOR DRIVING COAXIAL CABLE CONNECTORS

BACKGROUND OF THE INVENTION

Modern telecommunications make frequent use of coaxial cables. CATV installations represent perhaps the most frequently encountered use of coaxial cables but this is by no means the only application for this type of cabling. Special connectors have been developed for use with coaxial cable. These are commonly used to connect a device, such as a television, to a wall-mounted jack where an incoming signal line is terminated. Again there are many other common uses of coaxial cable connectors. A complete connector includes both a male half and a female half. Typically the female half is mounted on a wall jack and the male half is attached to the end of a cable to be connected to the wall jack, although it could be reversed from this arrangement.

In the United States there are two primary coaxial connector types, the F-type connector and the BNC connector. An example of a BNC connector is shown in U.S. Pat. No. 6,609,925, the disclosure of which is incorporated herein by reference. The male half of each type generally includes a male shell the interior of which has an elastomeric sleeve and a center pin. An annular attachment ring is mounted on the exterior of the male shell and is freely rotatable thereon. The major differences between the two connector types lie in the attachment rings and their mating counterparts on the female half of the full connector. The F-type attachment ring has an internal thread at its free end and external hexagonal flats near its inner end. The threads engage mating external threads on the female half of the full connector when the hex surface of the attachment ring is rotated. The BNC attachment ring has spiral grooves in it that receive mating pins on the female shell. An external knurled portion provides a gripping surface for engaging and rotating the attachment ring to cause the pins of the female half to seat in detents at the ends of the spiral grooves. It will be understood that both the male and female halves of the full connector include additional components such as washers, spring washers, pins, clamp nuts and the like which are not directly pertinent to the present invention.

Installers of coaxial cable systems have a need for a tool for driving the male halves of the connectors into engagement with the female halves. Such tools are available for driving one type of connector or the other. But due to the different sizes and characteristics of the attachment rings, a tool suitable for one type of connector cannot be used to drive the other type of connector. The present invention is directed to a single tool which can drive both F-type connectors and BNC type connectors.

SUMMARY OF THE INVENTION

The present invention concerns a driver tool for coaxial cable connectors. A primary object of the invention is a driver tool which can drive both F-type connectors and BNC connectors to either install or remove the connector from a mating port.

Another object of the invention is a tool of the type described which eliminates the need to carry separate tools for the two connector types.

A further object of the invention is a tool of the type described which does not require any adjustment, alteration or moving parts to accommodate both F-type connectors and BNC connectors.

Yet another object of the invention is a tool of the type described which is cost effective to make because it requires only minimal machining in the manufacturing process.

The driver tool of the present invention includes a socket which is preferably attached to a shaft which is in turn mounted in a handle. The socket has an annular construction with a slot formed therein for receiving a coaxial cable. The interior of the socket has first and second drive surfaces. The first drive surface is in the form of a plurality of flat segments formed on the socket and engageable in rotationally interlocking relation with the hex sleeve of an F connector. The second drive surface is in the form of a collar sized for frictional engagement in rotationally interlocking relation with the bayonet sleeve of a BNC connector. The first and second drive surfaces are axially adjacent each other in the interior of the socket.

These and other desired benefits of the invention, including combinations of features thereof, will become apparent from the following description. It will be understood, however, that a device could still appropriate the claimed invention without accomplishing each and every one of these desired benefits, including those gleaned from the following description. The appended claims, not these desired benefits, define the subject matter of the invention.

DETAILED DESCRIPTION OF THE INVENTION

Figure 1:
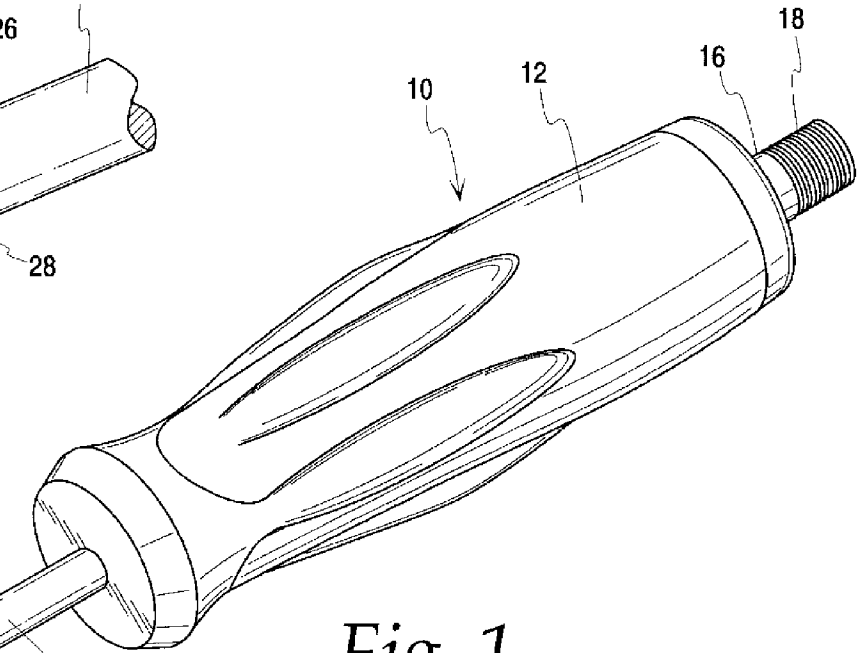
FIG. 1 is a perspective view of the coaxial cable connector driving tool of the present invention.
Figure 2:
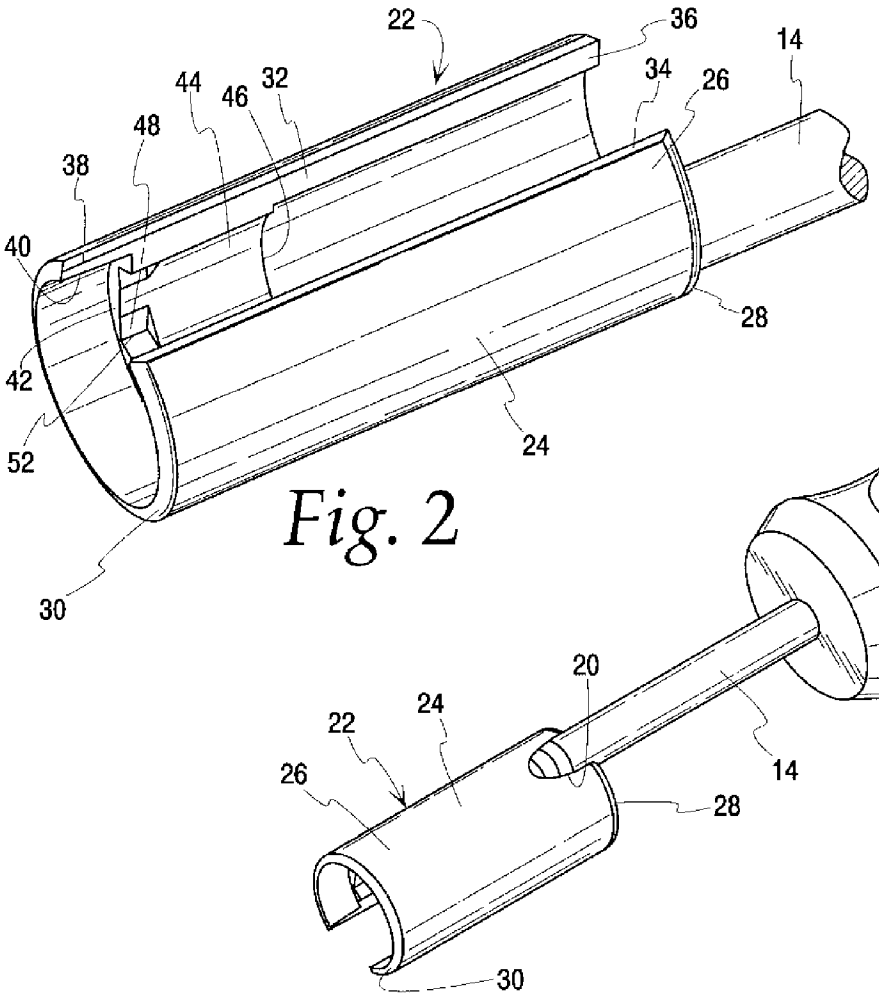
FIG. 2 is an enlarged perspective view of the socket portion of the driving tool.
Figure 3:
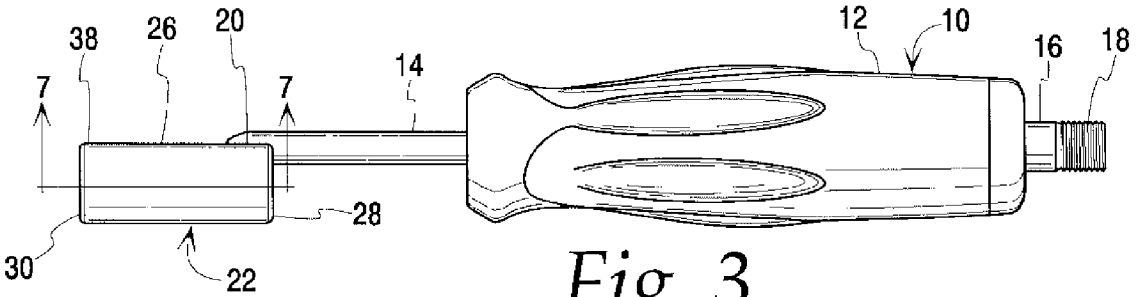
FIG. 3 is a side elevation view of the driving tool.
Figure 4:
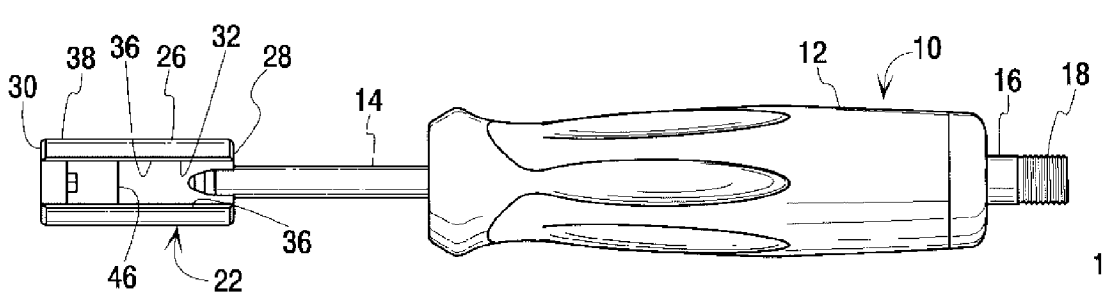
FIG. 4 is top plan view of the driving tool.
Figure 5:
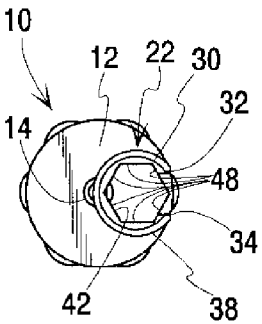
FIG. 5 is a front end elevation view of the driving tool.
Figure 6:
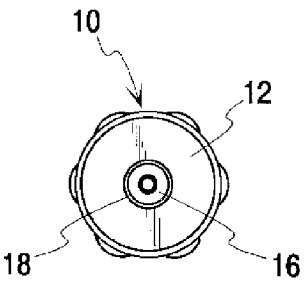
FIG. 6 is a rear end elevation view of the driving tool.

The coaxial cable connector driver tool of the present invention is illustrated generally at 10 in FIGS. 1–7. The tool includes a handle 12 in which is mounted a shaft or shank 14. The handle has a contoured shape for a comfortable fit in a user's hand. The butt end of the handle may optionally have a stubshaft 16 having threads 18 for mounting an F-type connector while attaching it to a coaxial cable. The distal end of the shaft 14 is slotted at 20. The slot receives a socket 22. The socket and shaft are welded or otherwise fixed to one another.

The socket 22 has a generally cylindrical body member 24. The external surface 26 of the body member has a constant diameter, except for slight radii 28 and 30 at the proximal and distal ends of the body member, respectively. The radii break any sharp edges. The body member is not a complete cylinder, however, as it has first and second longitudinal edges 32 and 34 which are spaced apart to define a longitudinal slot 36 between them. The body member is fixed to the shaft at the proximal end near radius 28.

Figure 7:
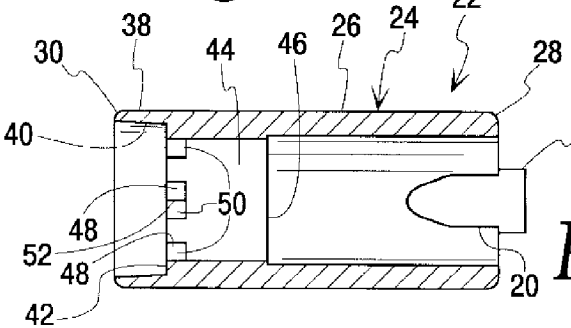
FIG. 7 is a section taken along line 7—7 of FIG. 3, on an enlarged scale.

While the external surface 26 of the body member 24 has a constant diameter, the internal surface of the body does not have a constant diameter. One example of this is the collar 38 at the distal end of the body member near radius 30. As seen in FIG. 7 the collar has an internal surface 40 which tapers radially inwardly from the distal end to a transition step 42. That is, the internal diameter of the collar tapers from a maximum at the distal end to a minimum at the transition step. The internal surface 40 of the collar forms a first drive surface of the socket. The transition step delineates an outer boundary of a central portion 44 of the body member having an increased wall thickness, and thus minimal internal diameter. The inner boundary of the central portion is at 46. Beginning at the transition step and extending axially into the central portion there are a series of flats.

Immediately adjacent the transition wall 40 the internal surface of the socket body 24 has a series of flat segments 48. The segments form 60° angles between one another. Collectively these segments 48 form the second drive surface. The flat segments may be formed by cutouts 50 in the central portion 44 of the socket body member. The cutouts include a corner 52. The corners define the boundaries between flat segments.

Figure 8:
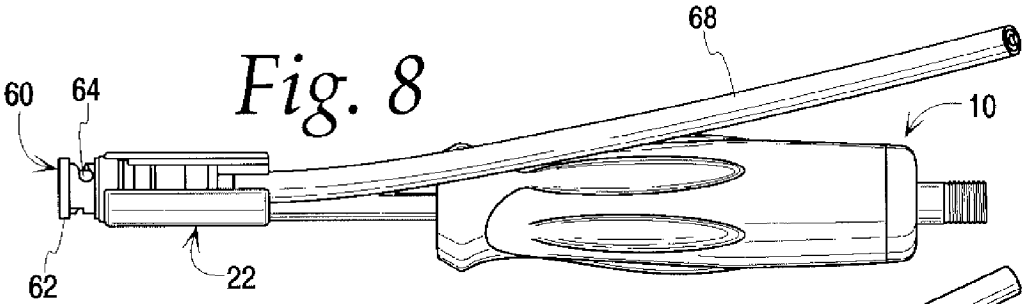
FIG. 8 is a side elevation view of the tool engaging a BNC connector on the end of a coaxial cable, with the tool rotated to show the slot in the socket.
Figure 9:
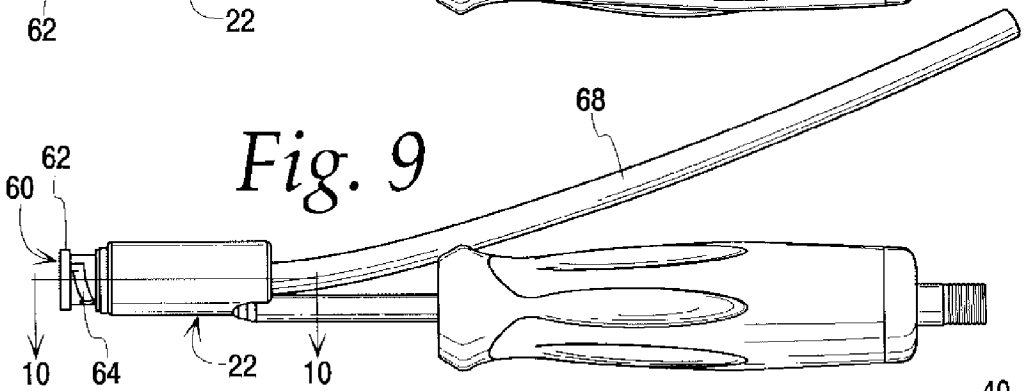
FIG. 9 is a view similar to FIG. 8, with the tool rotated so the slot in the socket is at the top of the figure.
Figure 10:
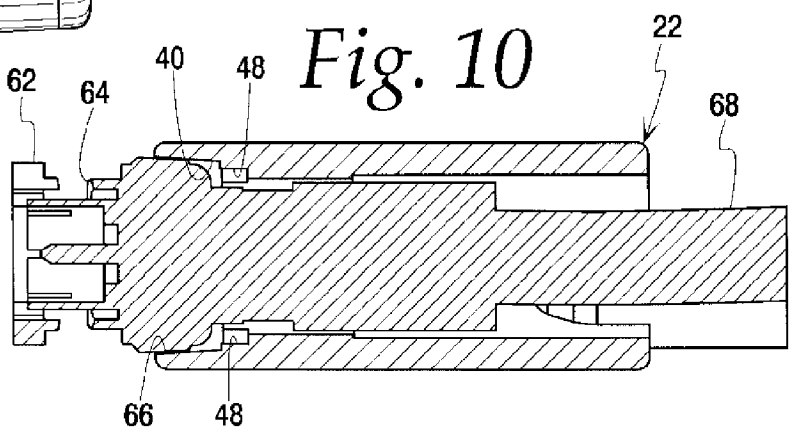
FIG. 10 is a section taken along line 10—10 of FIG. 9, on an enlarged scale, with the connector and cable indicated schematically.

A male half of a BNC connector and the use of the tool with this type of connector are shown in FIGS. 8–10. The BNC connector 60 has a bayonet attachment ring 62 which is freely rotatable on the body of the connector. The spiral grooves are visible at 64 in FIGS. 8 and 9. A knurled surface on the attachment ring is indicated schematically at 66 in FIG. 10. A coaxial cable attached to connector 60 is shown at 68. To use the driver tool 10 with the BNC connector the cable 68 is laid into the longitudinal slot 36 and then the cable is drawn toward the handle 12 to move the connector 60 into the socket 22 as seen in FIGS. 8 and 9. The connector will slide into the socket until the knurled surface 66 engages the first drive surface, namely, the surface 40 of the collar. With the drive surface 40 engaging the knurled surface 66 in frictional engagement, the user can axially move the connector 60 onto a mating female half (not shown) of the BNC connector, with the pins of the female half aligning with the spiral grooves 64. The user then rotates the tool, causing the attachment ring 62 to rotate and thereby seat the pins in the detents of the spiral grooves. This locks the two connector halves together. The user next pulls the tool axially away from the connector until the connector is completely out of the socket. Next a generally radial movement of the tool relative to the cable allows removal of the tool from the cable as the cable slips through and out of the slot 36.

Figure 11:
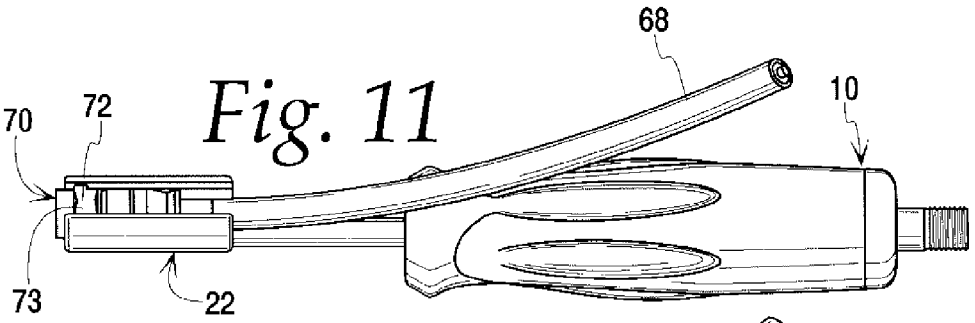
FIG. 11 is a side elevation view of the tool engaging an F-type connector on the end of a coaxial cable, with the tool rotated to show the slot in the socket.
Figure 12:
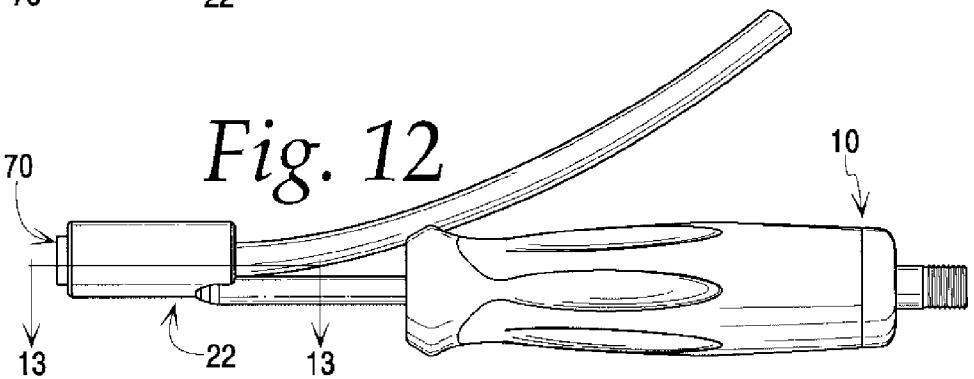
FIG. 12 is a view similar to FIG. 11, with the tool rotated so the slot in the socket is at the top of the figure.
Figure 13:
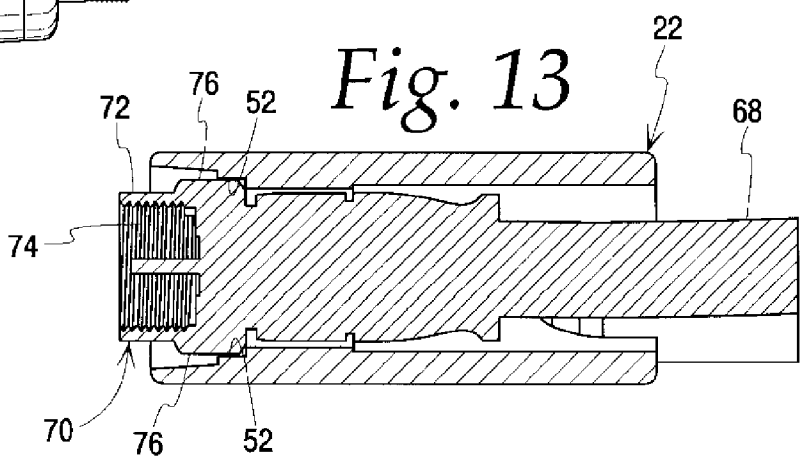
FIG. 13 is a section taken along line 13—13 of FIG. 12, on an enlarged scale, with the connector and cable indicated schematically.

A male half of an F-type connector and the use of the tool with this type of connector are shown in FIGS. 11–13. The F connector 70 has a hexagonal attachment ring 72 which is freely rotatable on the connector body. The attachment ring has six flat surfaces on its exterior, one of which can be seen at 73 in FIG. 11. The internal threads are visible at 74 in FIG. 13. The corners of the flat surfaces of the attachment ring are indicated schematically at 76 in FIG. 13. A coaxial cable attached to connector 70 is shown at 68. Use of the driver tool 10 with the F-type connector is similar to that just described. The user's actions are virtually identical; only the parts of the socket that engage the connector change. The cable 68 is laid into the longitudinal slot 36 of the socket and then the cable is drawn toward the handle 12 to move the connector 70 into the socket 22 as seen in FIGS. 11 and 12. The connector will slide into the socket until the flat surfaces 73 of the attachment ring 72 engage the second drive surface, namely, the flat segments 48. The axial extent of the cutouts 50 will limit the axial insertion of the connector 70. With the drive surface 48 engaging the flat surfaces 73 of the attachment ring, the user can axially move the connector 70 onto a mating female half (not shown) of the F connector, with the external threads of the female half aligning with the internal threads 74. The user then rotates the tool, causing the attachment ring 72 to rotate and thereby thread the connector halves onto one another. This locks the two connector halves together. The user next pulls the tool axially away from the connector until the connector is completely out of the socket. Then a generally radial movement of the tool relative to the cable allows removal of the tool from the cable as the cable slips through and out of the slot 36.

The above steps are generally reversed to remove a connector from its mating half. It can be seen from the described operation that the collar 38 and flat segments 48 provide first and second drive surfaces that are each compatible with one of the connector types so that a single tool can be used with either connector type. A user will no longer have to carry two tools or distinguish between them when trying to grab the proper tool from a tool belt, box or pouch.

While the preferred form of the invention has been shown and described herein, it should be realized that there may be many modifications, substitutions and alterations thereto. For example, while the collar and flat segments are shown adjacent one another at the distal end of the socket, it could be otherwise. The collar could be at one end of the socket and the flat segments could be at the other end of the socket. Also, while a six point socket is shown, the tool could alternately have a twelve point socket.

We claim:

1. A tool for driving coaxial cable connectors which have first and second attachment ring styles, the tool comprising a socket having a first drive surface engageable in driving relation with a coaxial cable connector having a first attachment ring style and a second drive surface engageable in driving relation with a coaxial cable connector having a second attachment ring style.

2. The tool of claim 1 wherein the first drive surface comprises a collar sized for frictional engagement with the coaxial cable connector having a first attachment ring style.

3. The tool of claim 1 wherein the second drive surface comprises a plurality of flat segments formed on the socket.

4. The tool of claim 2 wherein the socket includes a distal end and a transition step and the collar extends from the distal end to the transition step.

5. The tool of claim 4 wherein the socket defines an axis and the collar tapers from a greater distance from the axis at the distal end to a lesser distance from the axis at the transition step.

6. The tool of claim 3 wherein the collar is generally arcuate.

7. The tool of claim 1 wherein the first and second drive surfaces are adjacent one another.

8. The tool of claim 1 wherein the socket has a generally arcuate configuration with first and second longitudinal edges spaced apart to define a slot therebetween.

9. The tool of claim 1 further comprising a shaft attached to the socket and a handle attached to the shaft.

10. The tool of claim 1 wherein the socket has a generally arcuate configuration, and the first drive surface has a collar sized for frictional engagement with the coaxial cable connector having a first attachment ring style and the second drive surface has plurality of flat segments formed on the socket.

11. A tool for driving F-series coaxial cable connectors having a hexagonal attachment ring and BNC coaxial cable connectors having a bayonet attachment ring, the tool comprising a socket having a first drive surface engageable in rotationally interlocking relation with a bayonet attachment ring and a second drive surface engageable in rotationally interlocking relation with a hexagonal attachment ring.

12. The tool of claim 11 wherein the first drive surface comprises a collar sized for frictional engagement with the coaxial cable connector having a first sleeve style.

13. The tool of claim 11 wherein the second drive surface comprises a plurality of flat segments formed on the socket.

14. The tool of claim 12 wherein the socket includes a distal end and a transition step and the collar extends from the distal end to the transition step.

15. The tool of claim 14 wherein the socket defines an axis and the collar tapers from a greater distance from the axis at the distal end to a lesser distance from the axis at the transition step.

16. The tool of claim 13 wherein the collar is generally arcuate.

17. The tool of claim 11 wherein the first and second drive surfaces are adjacent one another.

18. The tool of claim 11 wherein the socket has a generally arcuate configuration with first and second longitudinal edges spaced apart to define a slot therebetween.

19. The tool of claim 11 further comprising a shaft attached to the socket and a handle attached to the shaft.

20. The tool of claim 11 wherein the socket has a generally arcuate configuration, and the first drive surface has a collar sized for frictional engagement with the coaxial cable connector having a bayonet attachment ring style and the second drive surface has plurality of flat segments formed on the socket.

* * * * *